United States Patent [19]

Behning

[11] Patent Number: 4,773,871

[45] Date of Patent: Sep. 27, 1988

[54] HIGH VOLTAGE BULKHEAD COUPLING

[75] Inventor: Christian D. Behning, Plymouth, Mass.

[73] Assignee: Alden Research Foundation, Westboro, Mass.

[21] Appl. No.: 68,160

[22] Filed: Jun. 29, 1987

[51] Int. Cl.[4] ..... H01R 13/53

[52] U.S. Cl. ..... 439/181; 439/551; 439/934

[58] Field of Search ..... 285/14, 161; 174/18, 174/153 R; 439/181, 550, 551, 921, 934, 277, 519

[56] References Cited

U.S. PATENT DOCUMENTS

| | | | |
|---|---|---|---|
| 2,655,638 | 10/1953 | Allen | 174/153 R |
| 2,700,144 | 1/1955 | Flanagan, Jr. | 174/153 R |
| 2,806,999 | 9/1957 | Pichitino | 174/153 R |
| 3,037,165 | 5/1962 | Kerr | 174/153 R |
| 3,491,198 | 1/1970 | Mangels | 439/551 |
| 3,749,424 | 7/1973 | Greene | 285/161 |
| 3,960,429 | 6/1976 | Moulin | 439/551 |
| 4,577,923 | 3/1986 | Ikemizu | 439/876 |
| 4,653,835 | 3/1987 | Schulte et al. | 439/551 |

*Primary Examiner*—Gil Weidenfeld
*Assistant Examiner*—Gary F. Paumen
*Attorney, Agent, or Firm*—James H. Grover

[57] ABSTRACT

According to the invention a high voltage electrical coupling for attachment through a wall comprises a coupling body around a high voltage conductor and having a flange abutting one side of the wall and an external thread extending from the flange through the wall; and a nut with internal threads screwing onto the external thread and a face abutting the other side of the wall; wherein at least one of said body and nut is of dielectric material and the nut has air channels in its abutting face extending outwardly from its internal threads to its exterior for releasing air from the threads and face when the nut is screwed into abutment with the wall.

7 Claims, 2 Drawing Sheets

HIGH VOLTAGE BULKHEAD COUPLING

BACKGROUND OF THE INVENTION

When it is necessary to supply high voltage (hundreds to thousands of volts) through a dielectric bulkhead or other insulative wall separating air from a volume of oil, for example, it is impractical to run a cable through the wall or through a stuffing box bonded to the wall. Instead high voltage has been commonly supplied by a threaded coupling feeding through the wall and secured to the wall by a nut screwed on the threads of the coupling. Within the insulation of the coupling is a high voltage conductor extending to a terminal on one side of the wall. The mating threads of the coupling and the nut necessarily extend to an opening in the wall which is at or near ground potential with respect to the high voltage on the terminal side. Air tends to become trapped in the space between the nut and the wall and in the mating threads leading to the opening in the wall.

Whether the air space is continuous between the nut and the wall or along the threads, or is broken into one or more air pockets, the air will become ionized by the electric field between the high voltage potential on the oil filled side of the wall and the ground potential at the wall. Although oil will not support a corona the ionized air will support a corona discharge which erodes the dielectric material and sooner or later results in a breakdown in its insulative property and high voltage arcing.

It is the object of the present invention to provide a high voltage bulkhead coupling which eliminates or minimizes air trapped at or near the bulkhead opening and thus greatly reduces failure due to corona and allows supply of substantially higher voltages than prior couplings.

SUMMARY OF THE INVENTION

According to the invention a high voltage electrical coupling for attachment through a wall comprises a coupling body around a high voltage conductor and having a flange abutting one side of the wall and an external thread extending from the flange through the wall; and a nut with internal threads screwing on the external thread and a face abutting the other side of the wall; wherein at least one of said body and nut is of dielectric material and the nut has air channels in its abutting face extending outwardly from its internal threads to its exterior for releasing air from the threads and face when the nut is screwed into abutment with the wall.

DRAWING

DESCRIPTION

Figure 1:
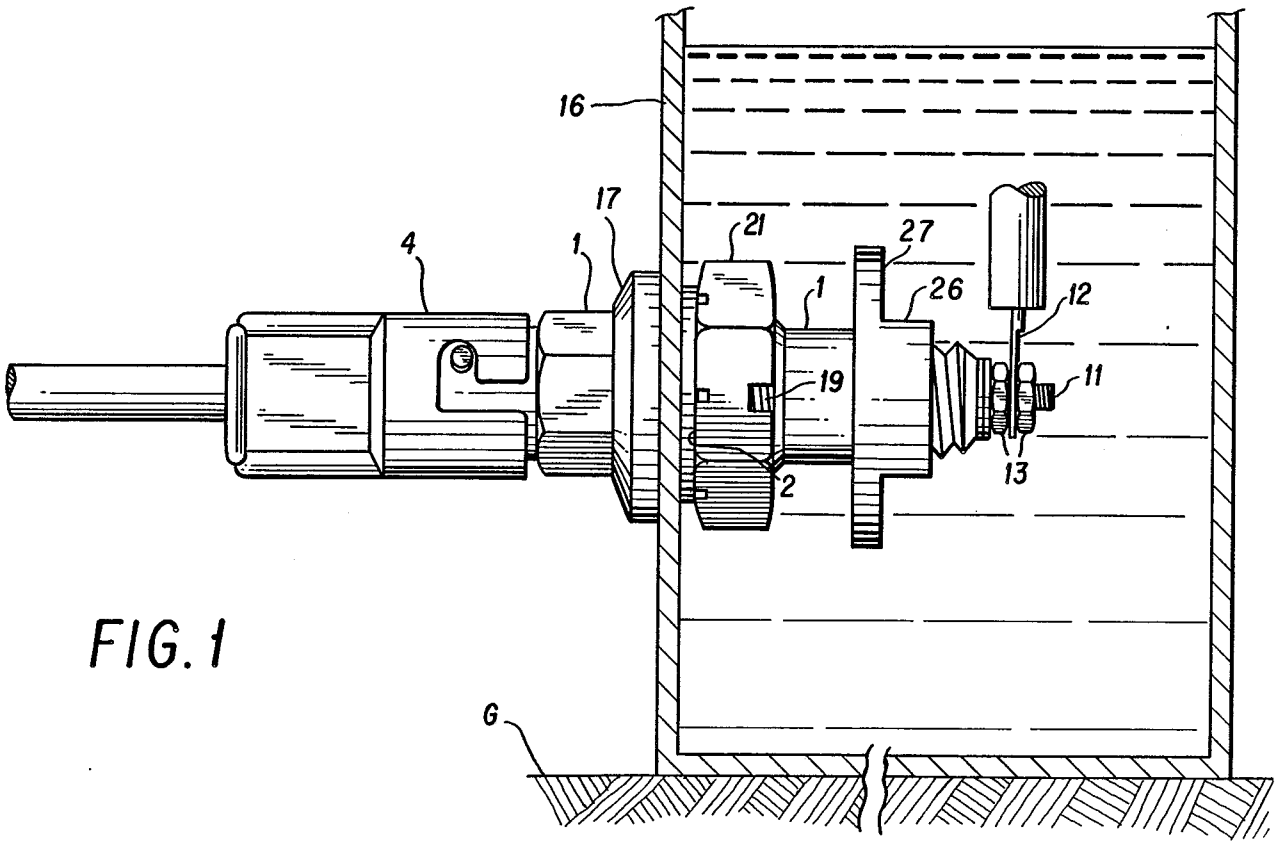
FIG. 1 is a side elevation of a high voltage coupling with a nut channeled according to the invention.
Figure 2:
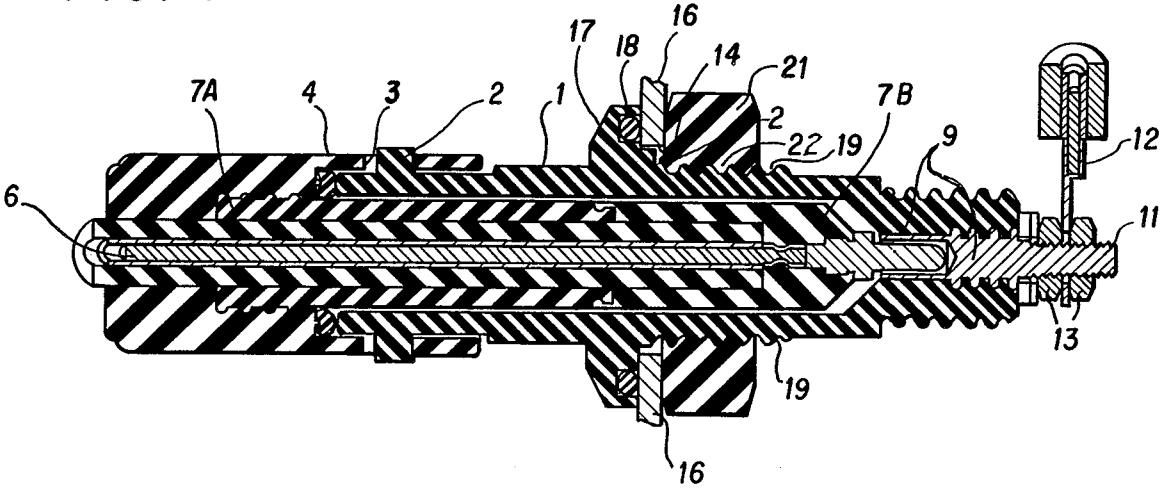
FIG. 2 is a side section of the coupling.
Figure 4:
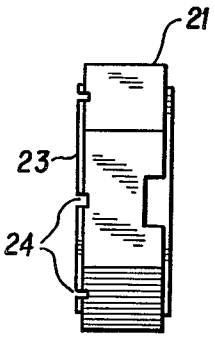
FIG. 4 is a side elevation of the nut.
Figure 3:
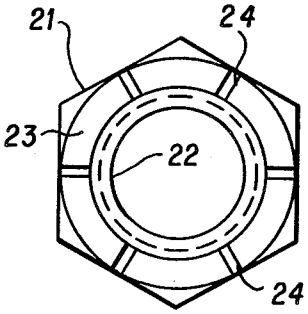
FIG. 3 is an end elevation of the nut of FIG. 1.

As shown in FIGS. 1 and 2 the coupling comprises a dielectric or insulative main body 1 having keys 2 making a bayonet attachment in the slots 3 of an insulative connector 4. Within the connector 4 is a doubly insulated high voltage conductor 6 bonded to a two part premolded, insulated jacket 7A, 7B which is in turn bonded to the connector 4. At the end of the jacket 7A, 7B is a terminal 8 electrically and mechanically connected to the conductor 6 and adapted to plug in a receptacle 9 within the opposite end of the main body 1 from the bayonet attachment. The receptacle 9 extends to an externally threaded, high voltage terminal 11 to which a conductor lug 12 may be connected by nuts 13.

The main body 1 of the coupling is adapted to extend through a circular opening 14 in a wall 16 between the atmosphere and a volume of oil, for example, in a transformer. In its midportion the main coupling body 1 has an annular flange 17 abutting the atmospheric side of the wall 16 and compressing an O-ring 18 against the wall. A main externally threaded portion 19 of the body extends from the flange 17 through the wall opening 14 and sufficiently beyond the opening into the oil volume to receive a clamping nut 21 with internal threads 22.

The path from the high voltage terminal to the nut threads 22 is significantly lengthened by an auxiliary nut 26 with a radially extending, disk shaped skirt 27 of greater diameter than the nut 21. The nut 26 is screwed on an additional body thread of less diameter away from the wall.

The main coupling body 1, the channeled nut 21 and the skirted nut 26 are of dielectric material such as thermoplastic polyester supplied by Allied Corp., Morristown, N.J., under the trade name Petra 130-FR. Tightening the nut 21 into abutment with wall presses the flange 17 on the O-ring 18, but hitherto would also trap air in pockets at the face 23 of the nut which abuts the wall 16, in the clearance space between the wall opening 14 and the main coupling body 1, and along the interengaging threads of the nut 21 and the main body threads 19. Such air pockets lie on the path between the exposed high voltage terminal 11 through the opening 14 in the wall 16 to the flange 17, to the atmosphere and to ground potential G. As tortuous and as long as this exemplary path is, it can, at commonly supplied potentials of 1,000 to 50,000 volts, support an electrostatic field which will ionize any small air pocket on the path and locally erode and eventually break down the surrounding dielectric.

According to the present invention trapping of air pockets and corona erosion is substantially eliminated by providing the face 23 of the nut 21 which abuts the wall 16 with radial channels 24 extending from its internal threads 22 to its exterior. With such channels air is permitted to escape from the wall opening, from the face of the nut and from the threads as the nut closes to abutment against the wall. Oil, which does not support corona, will fill the channels, the threads and the wall opening. Four or more channels, preferably six, insure a top channel allowing air to escape and a bottom channel allowing oil to enter and purge air. Air exclusion is so effective that a 60,000 volt potential may be sustained without break down with a 2½ inch space between the high voltage terminal 11 and the wall where previously less than 1,000 volts would result in break down.

It should be understood that the present disclosure is for the purpose of illustration only and that this invention includes all modifications and equivalents which fall within the scope of the appended claims.

I claim:

1. A high voltage coupling for attachment through a wall confining an oil comprising:

a coupling body around a high voltage conductor and having a flange abutting one side of the oil confining wall and an external thread extending from the flange through the wall; and a nut with internal threads screwing on the external thread and a face abutting the other side of the wall;

wherein at least one of said body and nut is of dielectric material susceptible to high voltage erosion, and the nut has uninterrupted air channels in its abutting face extending outwardly from its internal threads to its exterior for releasing air from the threads and face and allowing replacement by corona-inhibiting oil as the nut is screwed into abutment with the wall.

2. A coupling according to claim 1 including an additional thread on the coupling body extending from the external thread away from the wall, and an auxiliary nut screwed on the additional thread and having a radially extending disk shaped skirt shielding the nut.

3. A coupling according to claim 1 wherein the coupling surrounds a conductor extending through the wall to a terminal beyond the nut.

4. A coupling according to claim 1 wherein the channels are radial.

5. A coupling according to claim 1 wherein the body and nut are of dielectric material.

6. A coupling according to claim 2 wherein the auxiliary nut is of dielectric material.

7. A coupling according to claim 6 wherein the body and nut are of dielectric material.

* * * * *